United States Patent [19]

Lakso

[11] Patent Number: 4,770,476

[45] Date of Patent: Sep. 13, 1988

[54] MULTIPLE DRAWER LOCKING SYSTEM

[76] Inventor: Matthew L. Lakso, 17 Bacon St., Westminster, Mass. 01473

[21] Appl. No.: 58,382

[22] Filed: Jun. 5, 1987

[51] Int. Cl.[4] ..... E05C 7/06

[52] U.S. Cl. ..... 312/220; 312/221; 312/215

[58] Field of Search ..... 312/215, 218, 219, 220, 312/221, 222

[56] References Cited

U.S. PATENT DOCUMENTS

| | | | |
|---|---|---|---|
| 950,813 | 3/1910 | Bodenstein | 312/220 |
| 970,933 | 9/1910 | Leese | 312/219 |
| 2,992,056 | 7/1961 | Thielker | 312/221 |
| 3,404,929 | 10/1968 | Wright et al. | 312/218 |
| 3,767,280 | 10/1973 | McLaughlin | 312/219 |
| 4,246,769 | 1/1981 | McLaughlin | 312/219 |
| 4,303,287 | 12/1981 | Taplin | 312/215 |
| 4,381,877 | 5/1983 | Stark | 312/220 |
| 4,447,098 | 5/1984 | Parker | 312/221 |

*Primary Examiner*—Victor N. Sakran

[57] ABSTRACT

A locking system for the drawers of a desk or file cabinet, etc., comprising a latch plate on each drawer, a simultaneously movable set of locking pins, one for each latch plate, and a line of discrete cylindrical elements to shift the locking pins from a single location, as by key or the like. The discrete elements are spring held, top and bottom, and can be jolted aside momentarily as an unlocked drawer is slammed to locked position.

7 Claims, 1 Drawing Sheet

MULTIPLE DRAWER LOCKING SYSTEM

FIELD OF THE INVENTION

1. Background of the Invention

Reference is made to copending application for File Cabinet Locking System, Ser. No. 011,888, filed Feb. 6, 1987 now U.S. Pat. No. 4,711,505, Dec. 8, 1987. In the present case, the discrete elements in the line of elements have been improved so that something like a pin or lug may be more advantageously utilized in between elements for rigidifying the line of discrete elements in the locking action, especially for remote control as by a key. The present invention is usable for locking all the drawers in a desk or file cabinet and allied areas, and the novel discrete element unit can be used in the situation disclosed in the aforesaid application for patent also.

2. Summary of the Disclosure

In a series of drawers of the like, a line of discrete elements is provided in the same relation as the balls illustrated in said patent application, but in this case the elements are generally cylindrical and aligned along their longitudinal axes, whereby a pin or lug of appropriate size can be interposed between elements and more positively move the line against the action of a spring or other elastomeric device, for locking and unlocking. Means is provided to actuate the pin or lug from a distance as by a key or the like and this means includes a rotary circular member on a fixed axis with the pin or lug in the line of discrete elements but offset from the axis of the rotary circular member. A flexible cord about the periphery of the circular member may be utilized to turn the rotary circular member to load the elastomeric device and lock the circular member down, i.e., in locking condition of the drawers, whereas when unlocked, the elastomeric device returns the line of elements up and the pin or lug, to unlocked condition of the drawers.

The actual drawer locks each comprise a pin in the line of discrete elements, and a pin receiver on each drawer arranged in cooperative relation. When the rotary locking member is loose or free, the drawers can be slid in and out without hinderance, but when the lock is in effect, the pins or lugs are down and enter vertical, open top slots in the several drawers, these slots being the said "pin receivers". The pin receivers are located in abutment type members or the drawers, and it is to be noted that the pins in the line of elements can be located along the line of elements where desired and the slotted abutments can also be attached to the respective drawer sides to match. When the line of discrete elements is locked, i.e., down, the elements are substantially fixed in position but not wholly so, and under impact can move along the line, as they are located on the spring or elastomeric device as a whole. The abutments on the drawers are provided with a cam nose so that with the line of elements "locked", in down, drawer locking relation, an open drawer may be slammed in, and the cam nose will impinge upon and jolt aside its locking pin momentarily, to allow the drawer to be returned to closed, locked condition.

PREFERRED EMBODIMENT OF THE INVENTION

Figure 1:
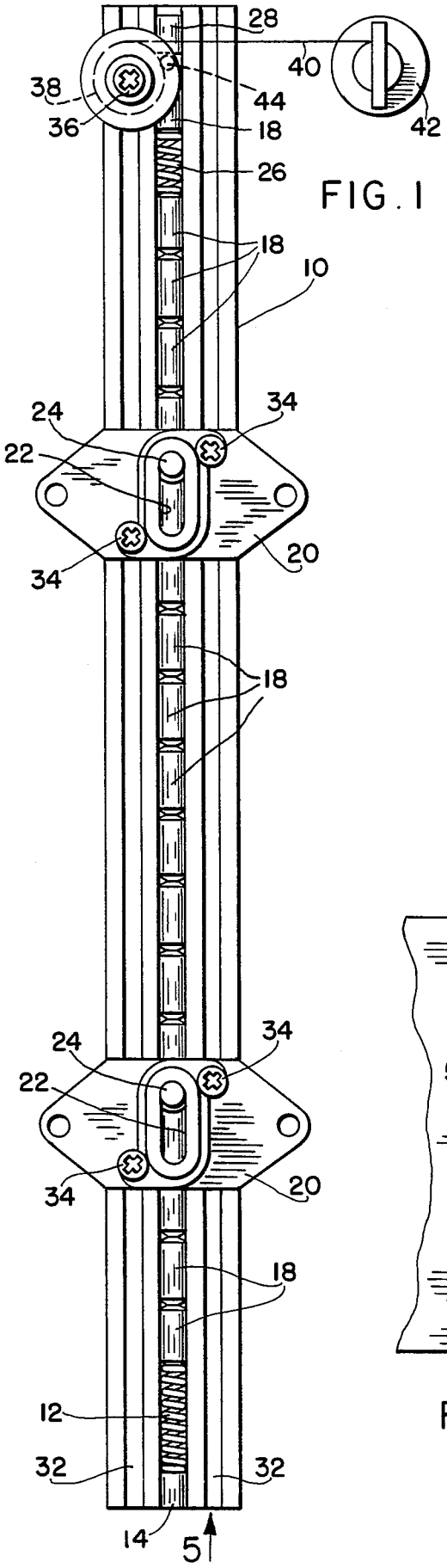
FIG. 1 is a front elevational view of a line of discrete elements and appurtenant parts, showing the locking pins in up, unlocking condition.

This invention is intended to simultaneously lock all the drawers of a filing cabinet, desk, bureau, or a similar chest of drawers type of furniture having stacked drawers. Usually a key operated lock will control the action, to lock or unlock all drawer members at once. A vertical track or receptor 10 is mounted interiorly of the housing or case for the drawers and extends vertically, facing the drawers as seen in FIG. 1. There is a spring 12 at the lower end held in the track by a plug 14, and a line of discrete elements 18 are held in the track, resting on this spring or other elastomeric device.

Figure 4:
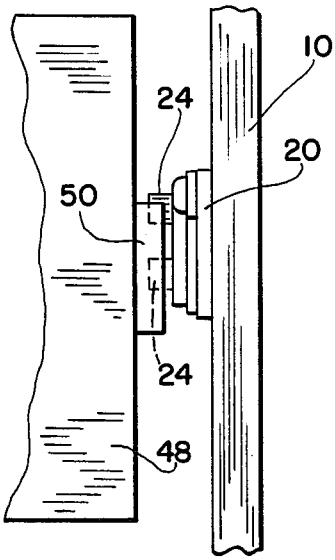
FIG. 4 is an edge view illustrating the relation of locking pin and slotted abutment.
Figure 5:
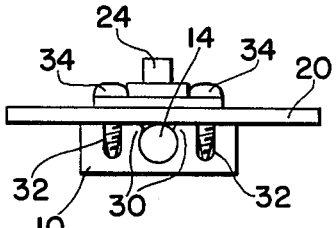
FIG. 5 is a bottom end view looking in the direction of arrow 5 in FIG. 1.

At intervals on the track there are mounted plates 20 each of which has a vertical slot 22 to accomodate a locking pin 24, slidable, with relation thereto and having an inner end interposed between a pair of elements 18, with the other or outer end projecting from the plate, see FIG. 4. Any means may be used to anchor the pins in the slots. At the upper end of the line of elements 18 there is preferably another spring 26, then at least one more element 18, and a closure plug 28. The plates 20 are merely mounted on the track or on a surrounding structure not shown by fasteners of any kind, as will be clear. The elements 18 are held in the track by overhangs 30 and slots 32 may be used to receive fasteners 34 for plates 20 and a fastener 36 for the rotary actuator 38 to be described.

Figure 2:
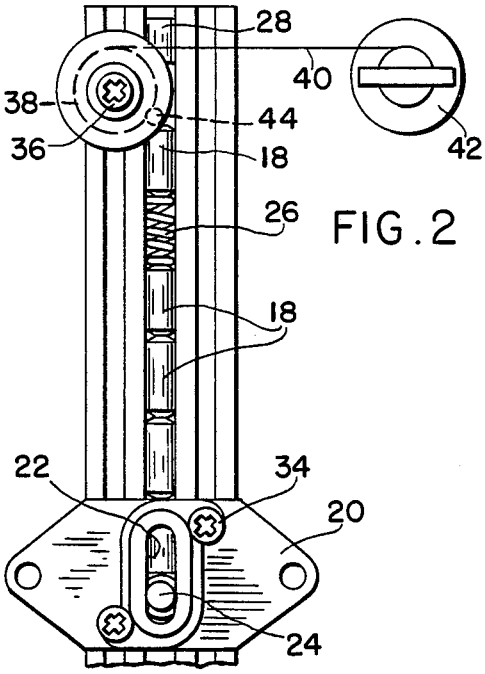
FIG. 2 is a similar partial view showing the locking pins in down, locking condition.

The rotary actuator 38 is mounted to rotate or oscillate on its axes and is actuated as by a flexible cord 40 inturn actuated by a manual device such as a lock 42. A pin or lug 44 is secured to rotary member 38 at a position offset from its axis, and this pin or lug 44 impinges upon the upper end of contigous discrete element 18, so that as cord 40 is moved to the right in FIG. 1, by key lock 42, the entire line of discrete elements is translated downwardly against spring 12, compressing it. The locking pins move down also, compare FIGS. 1 and 2, the plates 20 being fixed. When the locking pins 24 are up, the drawers are unlocked and free, when the locking pins 24 are down, they are in drawer locking position. The sole movement of locking pins 24 is vertical, in the slots 22.

Figure 3:
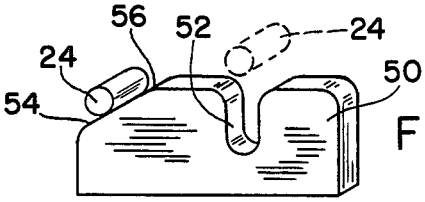
FIG. 3 is a perspective view illustrating a slotted abutment.

In FIG. 4, a drawer is indicated at 48. Each drawer 48 has a latch plate 50 thereon in cooperative position relative to a plate 20 and pin 24. Each plate 50 has a top open vertical slot or notch 52 which receives the respective locking pin 24 when down, in locking position, and the latch plates are free of locking pins 24 when they are up, FIG. 3 clearly the drawers cannot be withdrawn horizontally when the locking pins are in notches 52.

In the event that the circular rotary actuator 38 is turned to place the locking pins in locking position with a drawer open, such open drawer can be slammed shut by reason of a cam nose 54 at the leading edge of latch plate 50. This cam nose slams against the down pin 24, dotted lines FIG. 3, and due to the spring 26, jolts it up, over the hump 56, and seats it in notch 52, as the latch plate 50 and drawer are forces to the left in FIG. 3.

The individual discrete elements 18 are preferably generally cylindrical, but have tapered ends. This reduces friction and allows the pin or lug 44 to bear on the slope of the uppermost element 18, in FIG. 1.

I claim:

1. A locking system for a series of stacked drawers comprising a line of discrete elements having serially contacting areas, said line being arranged at an angle to the stack of drawers, means to contain the line of elements with access thereto, elastomeric means supporting the line of elements, elastomeric means impinging up on the line of elements at the end thereof opposite the elastomeric supporting means, means to selectively apply pressure to the line of elements and to release said pressure, said pressure applying means moving the line of elements against the resilient action of the elastomeric support, a series of spaced pin mounts on the element containing means, a pin on each pin mount, said pins extending in one direction into the line of elements and in the opposite direction outwardly of the respective mount, means on the pin mounts providing for motion of the respective pins with the elements as pressure is applied to the line of elements moving the line, and means on each drawer lockably receiving the respective pins in one position of the pins and releasing the pins in another position thereof.

2. The locking system of claim 1 wherein the means on the drawers to lockably receive the respective pins comprises a fixed member on each drawer having an open slot that selectively receives or releases the pins.

3. The locking system of claim 2 wherein each said fixed lock member has a forward cam nose that engages its respective pin and temporarily jolts the same aside to allow locking an open drawer by slamming it shut, when the pins are in lock position.

4. A construction comprising, a plurality of movable stacked members, said members being parallel and movable between housed, closed, condition and at least partly exposed condition, and means to lock the members in closed condition, said means comprising a line of aligned discrete elements, means to hold the line of elements adjacent the members, the line of elements being at an angle to the direction of motion of said members, the line of elements transsecting the members, an outstanding pin in the line of elements for each member, said elements and said pins being movable in a direction parallel to the line of elements, means limiting the motion of elements and pins, means to move the elements and pins as a unit between a member free condition and a member locked condition, means on each member to selectively receive its respective pin so that the member is locked by its pin in the member locked condition of its pin and free to be moved in member free condition of the pin, and means to move the line of elements and pins between member locked and member free conditions.

5. The construction of claim 4 including elastomeric means supporting the line of elements and providing for limited unitary motion thereof and of the pins.

6. The construction of claim 5 wherein the means to move the line of elements and pins comprises a movably mounted lug extending into the line of elements, and means to actuate the lug to move the line.

7. The construction of claim 6 including a rotatable member on which the lug is fixed, and the means to actuate the lug includes the rotatable member and means to rotate the member.

* * * * *